US009545537B2

(12) United States Patent
Savioli

(10) Patent No.: US 9,545,537 B2
(45) Date of Patent: Jan. 17, 2017

(54) EXERCISE DEVICE

(71) Applicant: Cristiano Savioli, Riccione (IT)

(72) Inventor: Cristiano Savioli, Riccione (IT)

( * ) Notice: Subject to any disclaimer, the term of this patent is extended or adjusted under 35 U.S.C. 154(b) by 0 days.

(21) Appl. No.: 14/769,343

(22) PCT Filed: Feb. 17, 2014

(86) PCT No.: PCT/IT2014/000039

§ 371 (c)(1),
(2) Date: Aug. 20, 2015

(87) PCT Pub. No.: WO2014/128738

PCT Pub. Date: Aug. 28, 2014

(65) Prior Publication Data

US 2016/0016029 A1 Jan. 21, 2016

(30) Foreign Application Priority Data

Feb. 22, 2013 (IT) ..... RN2013A0007

(51) Int. Cl.
*A63B 21/00* (2006.01)
*A63B 21/16* (2006.01)
(Continued)

(52) U.S. Cl.
CPC ..... *A63B 21/16* (2013.01); *A63B 21/4037* (2015.10); *A63B 2023/006* (2013.01); *A63B 2071/024* (2013.01); *A63B 2210/50* (2013.01)

(58) Field of Classification Search
CPC ..... A63B 21/16; A63B 21/4034; A63B 21/00047; A63B 21/4033; A63B 71/028; A63B 2071/024; A63B 21/4035; A63B 2023/006;A63B 2210/50; A63B 21/4049; A63B 23/1236; Y10T 428/2339; Y10T 428/24347; Y10T 403/7005; Y10T 403/7015
(Continued)

(56) References Cited

U.S. PATENT DOCUMENTS 2,855,201 A * 10/1958 Yetton ..... A63B 21/00047 482/34
3,415,475 A * 12/1968 Goodman ..... F16M 11/00 248/158
(Continued)

FOREIGN PATENT DOCUMENTS

AU 2010101204 A4 12/2010
CN 2208955 Y 10/1995
(Continued)

OTHER PUBLICATIONS

International Search Report dated Jun. 20, 2014 from counterpart application No. PCT/IT2014/000039.
(Continued)

*Primary Examiner* — Loan H Thanh
*Assistant Examiner* — Gregory Winter
(74) *Attorney, Agent, or Firm* — Shuttleworth & Ingersoll, PLC; Timothy J. Klima

(57) ABSTRACT

An exercise device, including a multi-layer platform, is equipped with a plurality of anchoring elements, which can be removably associated with cavities made in the platform. The association is made possible by matching surfaces interacting with one another, which are located respectively on the cavities and on the anchoring elements.

15 Claims, 7 Drawing Sheets

(51) Int. Cl.
*A63B 23/00* (2006.01)
*A63B 71/02* (2006.01)

(58) Field of Classification Search
USPC ..... 482/142; 403/348, 353
See application file for complete search history.

(56) References Cited

U.S. PATENT DOCUMENTS 4,129,395 A * 12/1978 Theurer ..... B60P 7/132 403/317
4,146,342 A * 3/1979 Cederholm ..... F16B 12/2009 403/247
5,076,571 A * 12/1991 Croce, Jr. ..... A63B 69/0022 472/90
5,100,130 A * 3/1992 Shoebrooks ..... A63B 21/4039 482/121
5,114,387 A * 5/1992 Keppler ..... A63B 21/4037 434/253
5,133,700 A * 7/1992 Braathen ..... A63B 21/4037 472/118
5,226,868 A * 7/1993 Montgomery ..... A63B 21/4035 482/141
5,417,636 A 5/1995 Havens
5,551,934 A 9/1996 Binette
5,759,139 A * 6/1998 Wright ..... A63B 21/4047 482/121
6,406,410 B1 * 6/2002 Lochbaum ..... A63B 21/00 482/111
7,648,449 B1 1/2010 Detert
2003/0104910 A1 6/2003 McCoy
2004/0014571 A1 * 1/2004 Haynes ..... A63B 21/0004 482/142
2008/0081153 A1 * 4/2008 Yeh ..... A01K 1/0157 428/156
2010/0299833 A1 12/2010 Kessler
2011/0136634 A1 * 6/2011 Batiste ..... A63B 21/4047 482/127
2012/0277077 A1 11/2012 Hsu et al.
2016/0046473 A1 * 2/2016 Jordan ..... A63B 43/002 81/3.09

FOREIGN PATENT DOCUMENTS

CN 201848048 U 6/2011
DE 10200013 8/2003
EP 1908497 A1 4/2008
WO WO2012016116 A2 2/2012

OTHER PUBLICATIONS

Chinese Office Action dated Aug. 1, 2016 for counterpart Chinese Patent Application No. 201480009802.7.

* cited by examiner

EXERCISE DEVICE

This application is the National Phase of International Application PCT/IT2014/000039 filed Feb. 17, 2014 which designated the U.S. and that International Application was published under PCT Article 21(2) in English.

This application claims priority to Italian Application No. RN2013A000007 filed Feb. 22, 2013, which application is incorporated by reference herein.

TECHNICAL FIELD

This invention relates to an exercise device, usable for sports, training or physical rehabilitation activities, and in other sectors.

The widespread nature of such activities in modern times, prompted by social trends and a widespread desire amongst people to be healthy, look good and achieve psychophysical wellbeing, has brought a significant increase in competitive sports, but above all has led a large number of men and women, from increasingly broad demographic groups, to frequent gyms, sports centres and various types of structures, which at the same time have evolved to increasingly professional levels, offering accessibly-priced services.

Such an expansion of physical-motor activities has been supported by in-depth analyses and studies on the physiological phenomena at the basis of sports activities, which led to the conception of working methods, machines and devices for carrying out specific exercises which are completely innovative compared with traditional ones. Even training systems which were developed some time ago, for example "Pilates", invented at the start of the twentieth century, have greatly come back into favour based on new knowledge and innovations relating to exercise machines and devices.

BACKGROUND ART

The most basic and widespread of such devices include thick and thin mats used for supporting the bodies of those persons who carry out "floor" exercises. Initially the fact that they were made from traditional materials guaranteed simply a certain degree of mechanical and thermal insulation, avoiding contact between the body and the bare floor. Subsequently, more specific materials were adopted, such as rubbers, sponges, paddings of various types, until the arrival of expanded (foam) plastic materials, such as polyurethane, EVA and others, able to guarantee greater effectiveness and comfort during use.

Recently, in the technical field of the sector, more technologically evolved apparatuses have become widespread, being able to improve and expand the range of performance.

For example, this is the case with mats made of soft plastic material, having through holes which allow the application of accessories and shaped members on them for performing exercises. One such device is described in U.S. patent 2010/0299833, but it shows several significant limitations. The first of them is due to the fact that, at the shaped members applied on the upper face of the mat, rigid fixing plates project on the lower face, which tend to alter the planarity of the mat. Moreover, the fitting and removal of such shaped members are quite laborious, making the device in question not very versatile, particularly if it needs to be used for a wide range of exercises and for various exercise disciplines.

Moreover, since such mats are usually made of flexible material, they cannot support tall accessories, such as vertical handles or rods for gripping or pushing, able to cause bending stresses on the mat which it cannot withstand.

Multi-layer mats are also used for floor exercises, comprising rigid layers able to guarantee a flat shape for the whole assembly, and soft layers, particularly in contact with the body of the person exercising, able to guarantee comfort and safety. However, in that case, as described for example in patent DE10200013, accessories cannot be applied to the mat. That means limitations making such devices incompatible with multi-purpose use, which in contrast is preferably required by operators in the sector.

DISCLOSURE OF THE INVENTION

The aim of this invention is, therefore, to eliminate the above-mentioned limitations and disadvantages.

The invention, whose features are described in the claims, achieves the aim by using a supporting platform for various exercises, consisting of alternating soft and rigid layers and having a plurality of cavities, in which supports can be inserted using a quick-coupling system.

The main advantage of this invention is basically the fact that the presence of supports, associated with slots in the thickness of the platform, guarantees the platform stability and maximum comfort for the user.

Another advantage of the invention is the fact that the association of the supports with the slots by means of quick couplings allows fast, easy changing of the set-up of the device depending on the exercises to be performed, making it particularly versatile and practical.

A further advantage of the invention is the fact that the shape of the platforms makes them easy to move manually and to reposition in limited spaces.

Finally, the shape of the supports allows them to be associated with accessories which have various outlines, depending on the exercises to be performed.

BRIEF DESCRIPTION OF THE DRAWINGS

Further advantages and features of the invention are more apparent in the detailed description which follows, with reference to the accompanying drawings, which illustrate a preferred embodiment without limiting the scope of the invention, in which.

DETAILED DESCRIPTION OF PREFERRED EMBODIMENTS OF THE INVENTION

An exercise device comprises a multi-layer platform 1, intended to support a user, consisting of at least a soft upper layer 1*a* and at least a rigid lower layer 1*b*, and provided with cavities 2, in which it is possible to insert from above a plurality of anchoring elements 3 for anchoring to the platform 1, which can be removably connected at one end 3*b* to the cavities 2, without any projection emerging below said platform 1.

Figure 5:
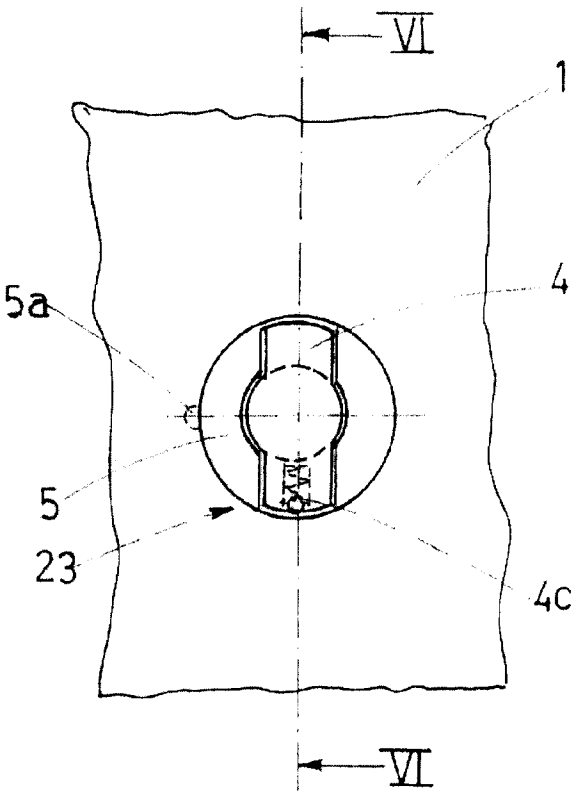
FIG. 5 is a bottom view of a possible alternative embodiment of the invention, with some parts cut away to better illustrate others.
Figure 6:
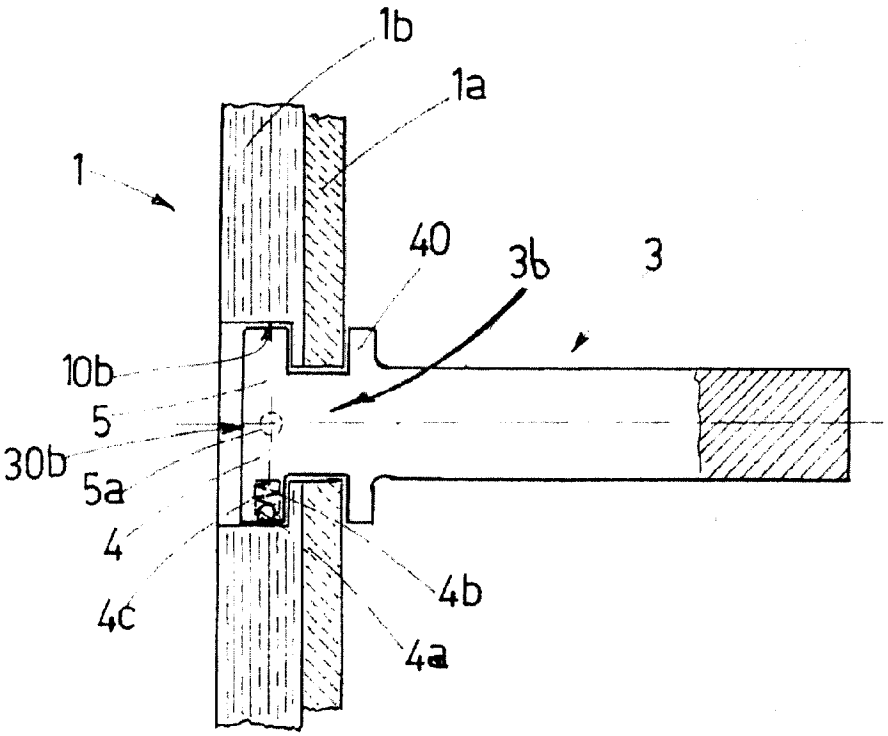
FIG. 6 is a cross-section of the invention according to the line VI-VI from FIG. 5.

The mutual connection of the platform 1 and the anchoring element 3 occurs, as illustrated in FIGS. 5 and 6, thanks to the interaction between matching surfaces 10*b*, 30*b*, respectively located on the rigid lower layer 1*b* of the platform 1 and on the end 3*b* of the anchoring element 3, as a result of a rotation applied to the anchoring element 3 in the cavity 2.

Figure 7:
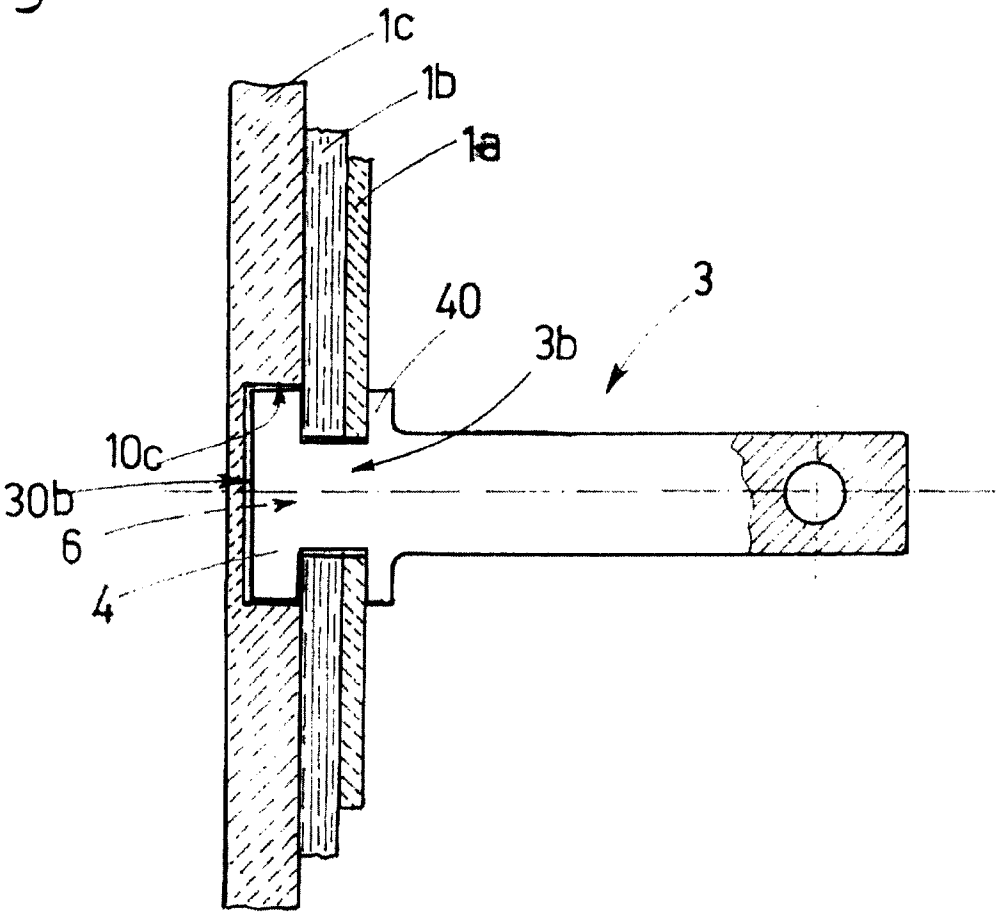
FIG. 7 is a cross-section similar to that shown in FIG. 4 of a further alternative embodiment.

It is evident that the cavities 2 may be either through cavities, as shown in FIGS. 1 to 6, or not through cavities, as shown in FIG. 7, provided that in any case the end 3*b* of the anchoring elements 3 does not project below the platform 1.

Figure 1:
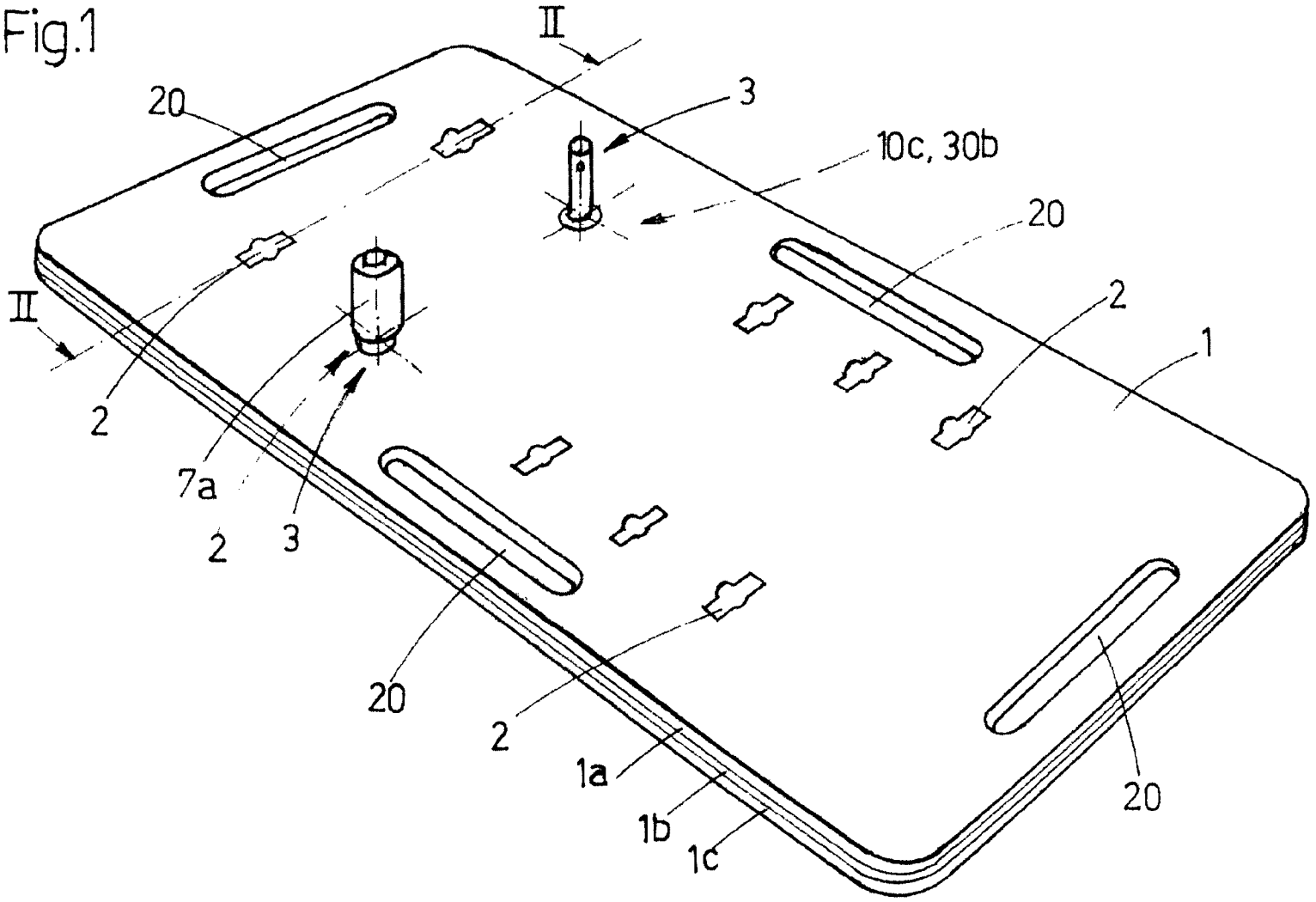
FIG. 1 is a perspective assembly view of the invention.
Figure 2:
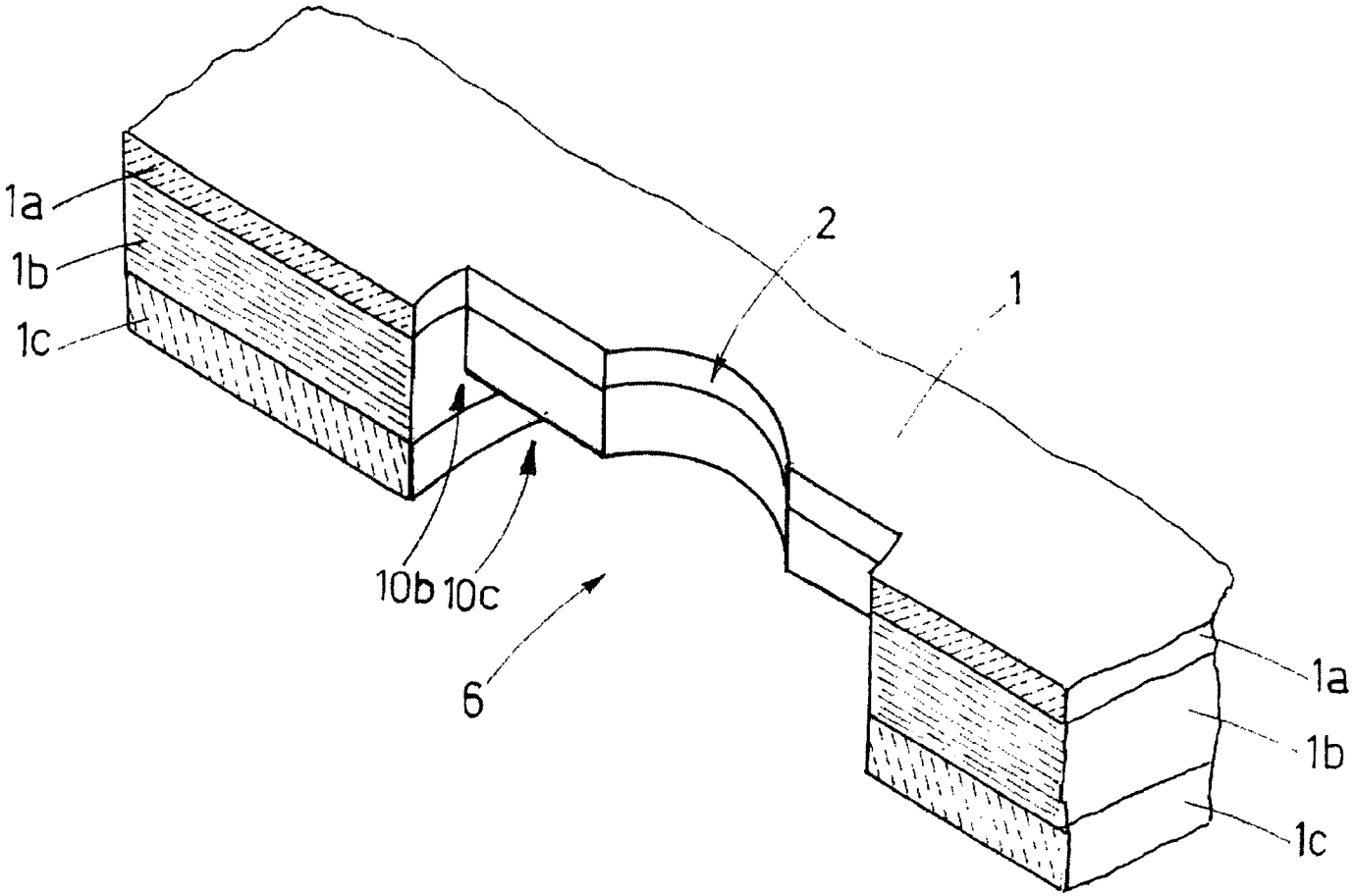
FIG. 2 is a cross-section of the invention according to the line II-II from FIG. 1, with some parts cut away to better illustrate others.
Figure 3:
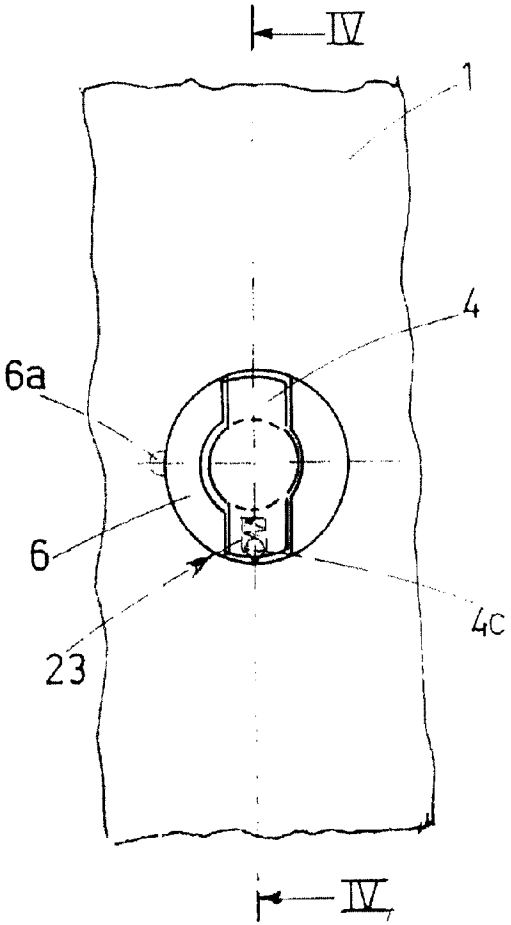
FIG. 3 is a bottom view of the invention, with some parts cut away to better illustrate others.
Figure 4:
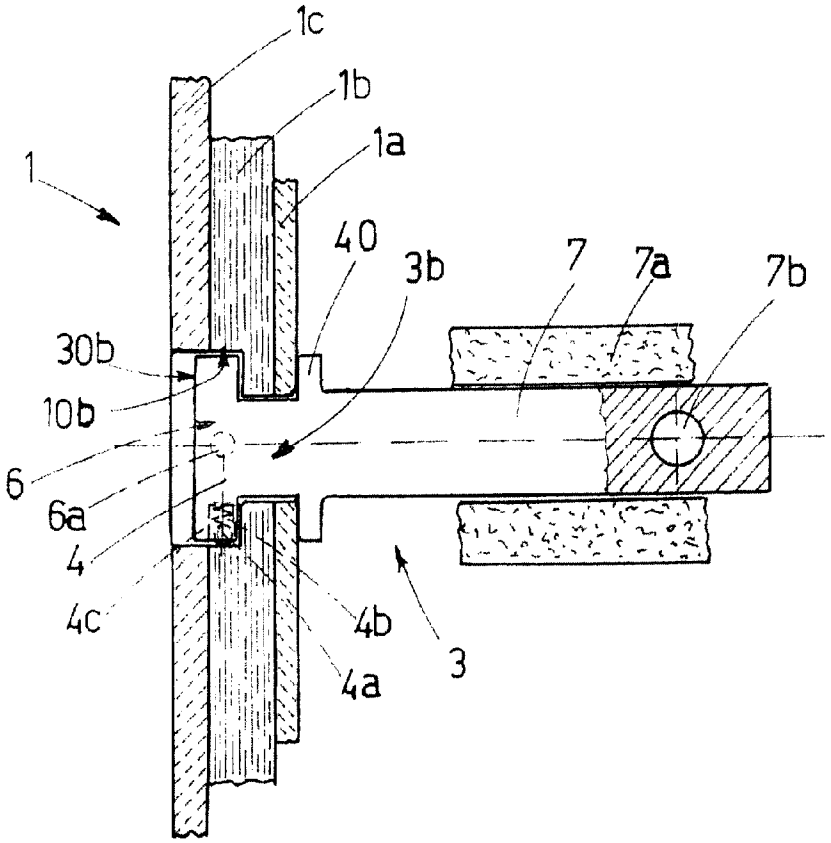
FIG. 4 is a cross-section of the invention according to the line IV-IV from FIG. 3.

In a preferred embodiment of the invention, as illustrated in FIGS. 1 to 4 and in FIG. 7, the platform 1 comprises a soft third layer 1*c*, associated with the rigid lower layer 1*b*, in such a way as to prevent the platform 1 from slipping relative to the floor. In that case, the mutual connection of the platform 1 and the anchoring element 3 occurs thanks to the interaction between matching surfaces 10*c*, 30*b*, respectively located on the third layer 1*c* and on the end 3*b* of the anchoring element 3, as shown in FIG. 7. The surface 10*b* of the rigid lower layer 1*b* may also cooperate with that interaction, as shown in FIGS. 2 and 4.

Figure 8:
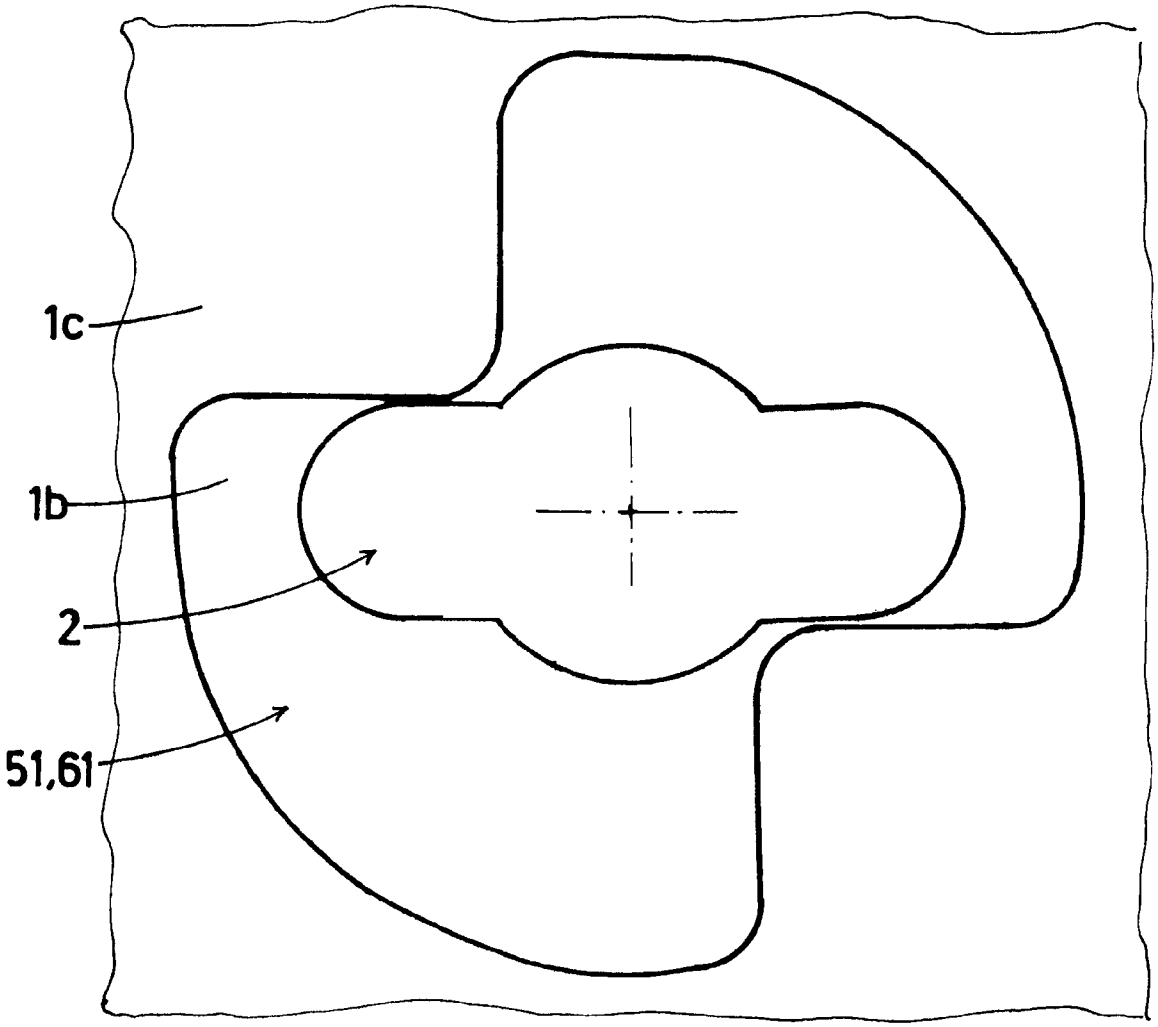
FIG. 8 is a bottom plan view of a detail of the invention.
Figure 9:
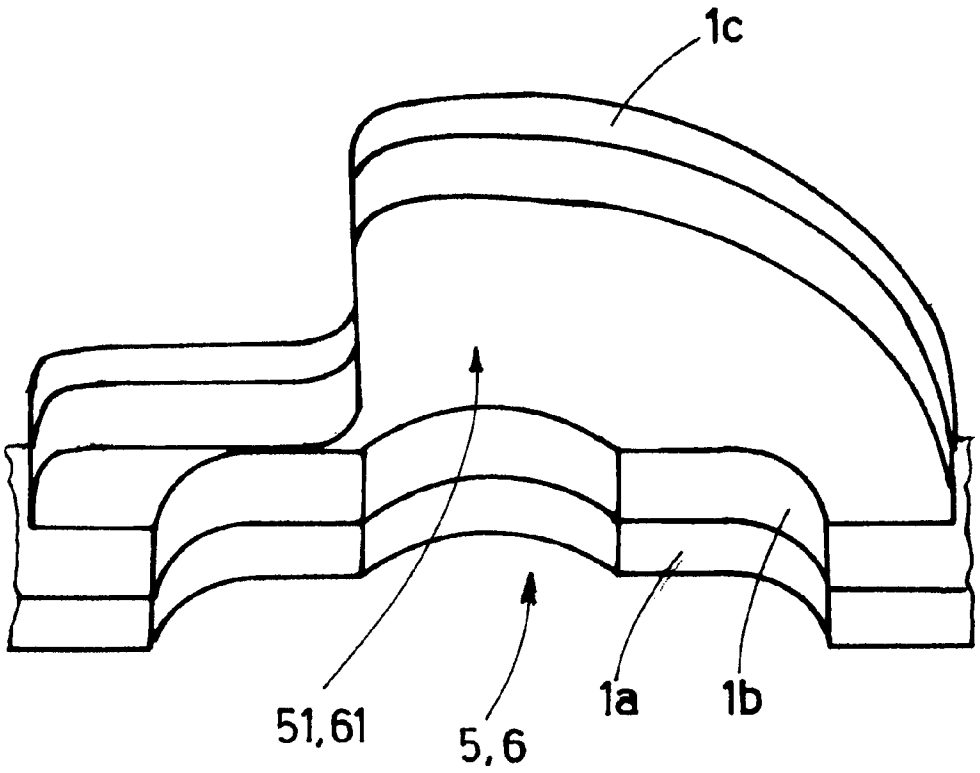
FIG. 9 is a perspective view of the detail of FIG. 8.

In any case, the matching surfaces 10*b*, 10*c*, 30*b* which cooperate with the interaction are located partly on the platform 1 and partly on the anchoring element 3: the surfaces 30*b*, relative to the anchoring element 3, are on a shaped protuberance 4, present on the end 3*b* of the anchoring element 3, whilst the surfaces 10*b*, 10*c* relate to hollows 5, 6 shaped to match the protuberance 4. In the embodiment illustrated in FIGS. 5 and 6, said hollow 5 is made in the rigid lower layer 1*b*. In the preferred embodiment of the invention, in which the platform 1 comprises three layers 1*a*, 1*b*, 1*c*, the hollow 6 can be made in the third layer 1*c*, as shown in FIG. 7, or it may involve both the rigid lower layer 1*b* and the third layer 1*c*, as shown in FIGS. 2 4. FIGS. 8 and 9 show, in the case of a platform 1 with three layers 1*a*, 1*b*, 1*c*, a preferred embodiment of the hollows 5; 6 for housing the protuberance 4. It can be seen how the hollow 5; 6 comprises a butterfly-shaped recess 51; 61, whose walls are suitable for interfering with the shaped protuberance 4 of the anchoring element 3, following a rotation of the latter. The shape of the butterfly-shaped recess 51; 61 is preferably symmetrical relative to the orientation of the cavities 2 of the platform 1, in such a way as to make rotation of the protuberance 4 of the anchoring element 3 symmetrical.

The end 3*b* of the anchoring element 3 also comprises a stop 40, located above the protuberance 4, suitable for interacting with the soft upper layer 1*a* when the anchoring element 3 is connected to the platform 1, in such a way as to improve its stability during exercising.

The anchoring elements 3 comprise a rigid core 7 and at least one covering element 7*a*, which may be a soft coating sleeve, or solid shaped members or special shaped members for performing specific exercises, which can be removably associated with the core 7, in such a way as to create various device geometries. Moreover, said rigid core 7 may comprise a transversal hole 7*b*, which can be used to allow the connection of two or more anchoring elements 3, in such a way as to create complex structures.

The rigid lower layer 1*b* of the platform 1 is preferably made of multi-layer wood, whilst the soft upper layer 1*a* and the soft third layer 1*c*, are preferably made of EVA expanded plastic material.

The multi-layer platform 1 also comprises a plurality of through slots 20, which allow easy manual gripping of it for moving and positioning the device 11.

The device 11 comprises an elastic coupling system 23, suitable for determining and stabilising the mutual connection position of the platform 1 and the anchoring elements 3. In a possible embodiment, schematically illustrated in FIGS. 3 to 6, said elastic coupling system 23 comprises at least one ball 4*a*, housed in a blind hole 4*c* present in the protuberance 4 and pushed towards the surface of the latter by a spring 4*b*, and an indentation 5*a*; 6*a* shaped to match it located in the hollow 5; 6, in such a way that the ball 4*a* engages in the indentation 5*a*; 6*a* in a predetermined connection position.

The invention claimed is:

1. An exercise device, comprising:

a multi-layer platform, and a plurality of anchoring elements, wherein the platform includes a soft upper layer, a rigid lower layer and a plurality of cavities passing through each of the upper layer and lower layer, wherein the anchoring elements include ends removably connectable to the cavities of the platform, wherein the rigid lower layer and the ends comprise matching surfaces allowing mutual connection of the platform and the anchoring elements, wherein the rigid lower layer comprises at least multi-layer wood, wherein the platform comprises a soft third layer, associated with the rigid lower layer, to prevent the platform from slipping relative to a floor surface, wherein the third layer includes a plurality of recesses positioned beneath the plurality of cavities, the recesses being larger than the cavities such that an upper surface of each recess is partly formed by a lower surface of the lower layer;

wherein the ends include protuberances shaped to pass through the cavities in the upper layer and lower layer and, when aligned with the third layer, to be rotatable in the recesses with respect to the cavities to be positioned under the lower surface of the lower layer to prevent withdrawal of the anchoring elements without further rotation of the protuberances to again align with the cavities.

2. The device according to claim 1, wherein the cavities are not through cavities.

3. The device according to claim 1, wherein the third layer and the ends of the anchoring elements comprise matching surfaces, being designed to allow mutual connection of the platform and the anchoring elements.

4. The device according to claim 1, wherein the end of each anchoring element comprises a stop, located above the protuberance, being designed to interact with the soft upper layer when the anchoring element is connected to the platform, in such a way as to stabilise a position of the anchoring element with respect to the platform.

5. The device according to claim 1, wherein at least one of the anchoring elements comprises a rigid core, and at least one covering element, which can be removably associated with the core, in such a way as to create various device geometries.

6. The device according to claim 5, wherein the rigid core comprises a transversal hole, designed to allow connection of two or more anchoring elements, in such a way as to create complex structures.

7. The device according to claim 1, wherein the soft upper layer and the soft third layer comprise at least EVA material.

8. The device according to claim 1, wherein the multi-layer platform comprises a plurality of through slots, designed to allow manual gripping of the device for moving and positioning the device.

9. The device according to claim 1, and further comprising an elastic coupling system, designed to determine and stabilise the mutual connection position of the platform and the anchoring elements.

10. The device according to claim 1, wherein the recesses are shaped to include generally arcuate portions that receive the shaped protuberances and, when the shared protuberances are aligned with the third layer, allow partial rotations of the anchoring elements with respect to the platform while preventing full rotations of the anchoring elements with respect to the platform.

11. An exercise device, comprising:

a multi-layer platform, and an anchoring element, wherein the platform includes a soft upper layer, a rigid lower layer and a plurality of cavities passing through each of the upper layer and lower layer, wherein the anchoring element includes an end removably connectable to the cavities of the platform, wherein the rigid lower layer and the end comprise matching surfaces allowing mutual connection of the platform and the anchoring element, wherein the rigid lower layer comprises at least multi-layer wood, wherein the platform comprises a soft third layer, associated with the rigid lower layer, to prevent the platform from slipping relative to a floor surface;

wherein the third layer includes a plurality of recesses positioned beneath the plurality of cavities, the recesses being larger than the cavities such that an upper surface of each recess is partly formed by a lower surface of the lower layer;

wherein the end includes a protuberance shaped to pass through the cavities in the upper layer and lower layer and, when aligned with the third layer, to be rotatable in the recesses with respect to the cavities to be positioned under the lower surface of the lower layer to prevent withdrawal of the anchoring element without further rotation of the protuberance to again align with the cavities.

12. The device according to claim 1, wherein the cavities are not through cavities.

13. The device according to claim 11, wherein the end of the anchoring element comprises a stop, located above the protuberance, being designed to interact with the soft upper layer when the anchoring element is connected to the platform, in such a way as to stabilise a position of the anchoring element with respect to the platform.

14. The device according to claim 11, and further comprising an elastic coupling system, designed to determine and stabilise the mutual connection position of the platform and the anchoring element.

15. The device according to claim 11, wherein the recesses are shaped to include generally arcuate portions that receive the shaped protuberance and, when the shaped protuberance is aligned with the third layer, allow partial rotation of the anchoring element with respect to the platform while preventing full rotation of the anchoring element with respect to the platform.

* * * * *